US006837594B2

(12) United States Patent
Paquette et al.

(10) Patent No.: US 6,837,594 B2
(45) Date of Patent: Jan. 4, 2005

(54) DECORATIVE LOW-POWER ILLUMINATION APPARATUS

(75) Inventors: James G. Paquette, 3401 Old Level Rd., Havre de Grace, MD (US) 21778; Mark MacLean-Blevins, Westminster, MD (US)

(73) Assignee: James G. Paquette, Havre de Grace, MD (US)

( * ) Notice: Subject to any disclaimer, the term of this patent is extended or adjusted under 35 U.S.C. 154(b) by 0 days.

(21) Appl. No.: 10/270,635

(22) Filed: Oct. 16, 2002

(65) Prior Publication Data

US 2004/0075999 A1 Apr. 22, 2004

(51) Int. Cl.[7] ..... F21V 35/00

(52) U.S. Cl. ..... 362/226; 362/392; 362/276; 362/802

(58) Field of Search ..... 362/392, 276, 362/802, 810, 226, 145, 151, 152; 340/567, 693.6, 693.8

(56) References Cited

U.S. PATENT DOCUMENTS 5,601,360 A 2/1997 Paquette
6,087,938 A * 7/2000 Gitelis et al. ..... 340/567

* cited by examiner

*Primary Examiner*—Thomas M. Sember
(74) *Attorney, Agent, or Firm*—Rosenberg, Klein & Lee

(57) ABSTRACT

A low-power illumination apparatus may be used in areas where conventional incandescent illumination would be unsafe, especially to children or small pets. The apparatus may be configured to appear as a window candle and can be safely installed in windows which are easily accessible to children. Safe application is accomplished by supplying a low-wattage bulb with a low voltage, providing a resettably-fused bulb supply within the apparatus to prohibit the use of high-wattage bulbs and an interlocking base attached to the window frame which prevents the apparatus from being inadvertently removed or tipped over.

38 Claims, 10 Drawing Sheets

DECORATIVE LOW-POWER ILLUMINATION APPARATUS

FIELD OF THE INVENTION

This invention generally relates to decorative illumination systems. More specifically, this invention relates to illumination systems for use in home or commercial edifices. More particularly, this invention relates to a low-power illumination apparatus that may be safely deployed in areas regularly occupied by or accessible to children or pets due to the low heat production by the apparatus. The subject invention is particularly adapted in certain embodiments to be mounted in the window sills of edifices to provide a decorative and safe illumination system. Additionally, the subject invention is directed to a decorative illumination system which may be built into a building's frame at the time of construction which permits most, if not all, of the necessary wiring to be hidden from the occupants' view.

BACKGROUND OF THE INVENTION

A persistent challenge in the field of illumination is the safe location of the illumination source in avoidance of the heat produced by the source. It has been established that the onset of pain due to excess heat corresponds with the temperature at which tissue damage occurs, 40° to 45° C., a temperature range far exceeded by traditional illumination systems. Thus, many desired illumination applications have been precluded for use in establishments where children have access to illumination systems due to hazardous levels of heat dissipated by the light source.

Illumination safety is of particular concern in areas where children or pets have direct access to the illumination source. As children, and to a lesser degree pets, are drawn to and have a fascination with light, especially decorative lamps, great care must be taken to protect the child from injury by contact with a heated lamp. Generally, preventative measures in the past have involved placing the illumination source high above the floor or by surrounding the hot bulb with a screen or a shade. However, these measures are not available in such lighting applications as electric window candles, which utilize a bare bulb in openly accessible windows.

As demonstrated by the foregoing discussion, there exists a need for a decorative illumination device that may be safely placed in low lying areas without the requirement of screen, shade, or other extraneous protective measures. Additionally, there exists a need for an illumination system wherein the required wiring and other system elements remain inaccessible to and hidden from view, such that the possibility of electrical accidents and injury is diminished.

SUMMARY OF THE INVENTION

The low-power illumination apparatus of the present invention provides decorative illumination while dissipating heat at a temperature below the hazardous temperatures discussed above. Thus, the present invention can be utilized in low lying areas wherein children and pets may have access.

In a preferred embodiment of the instant invention, the low-power illumination apparatus is configured to appear as an electric candle placed on the sill of a window. In actuality, the window candle is fixedly secured to the window sill by means of a base mounting plate, which is electrically coupled to low voltage house wiring, e.g., 24 VAC.

An illumination housing forming the candle portion of the illumination apparatus is slidably received into the base mounting plate and is electrically and mechanically coupled thereto. The illumination housing encloses a power conversion circuit which reduces and regulates the low voltage house wiring to a final lamp voltage, e.g., 12 VDC. Electrically interposed between the power conversion circuit and the lamp of the illumination housing is a resettable fuse, which opens if the power consumption of the bulb installed exceeds the safety threshold imposed by the invention.

The low-power illumination apparatus of the present invention includes a decorative base collar configured to appear as the candle holder portion of the window candle. The lower surface of the decorative base collar has formed thereon a recess corresponding in shape and size to the base mounting plate.

When the decorative base collar is in place, the illumination housing is prevented from being slidably removed from the base mounting plate as lateral motion is prohibited by the recess of the base collar being in contact with the base mounting plate. However, when it is desired to remove the illumination housing from the base mounting plate, one simply removes the base collar first and the sliding removal of the illumination housing is easily performed. With the illumination housing removed, the base mounting plate may be protected by the application of a cover. The cover also prevents children and pets from having access to the low voltage electrodes installed on the base mounting plate.

The low-power illumination of the present invention affords a variety of decorative effects by providing interchangeable components of the low-power illumination apparatus. The invention includes interchangeable decorative base collars as well as interchangeable decorative sleeves for changing the appearance of the illumination housing. Furthermore, a variety of different shaped lamps or bulbs may be used, provided they do not exceed the predetermined wattage safety level.

Still further, all operating components and connections may be formed in the frame of the edifice and/or hidden from external view to lessen the possibility of accidents occurring where an individual may be injured.

A further object of the present invention is to provide an auxiliary circuit in the illumination housing of the low-power illumination apparatus. The auxiliary circuit may embody an intruder alarm sensor, e.g., a shock vibration detector, an IR detector or a continuity loss detector, which can be deployed in each window opening where the low-power illumination apparatus is installed.

DETAILED DESCRIPTION OF THE PREFERRED EMBODIMENTS

Figure 1:
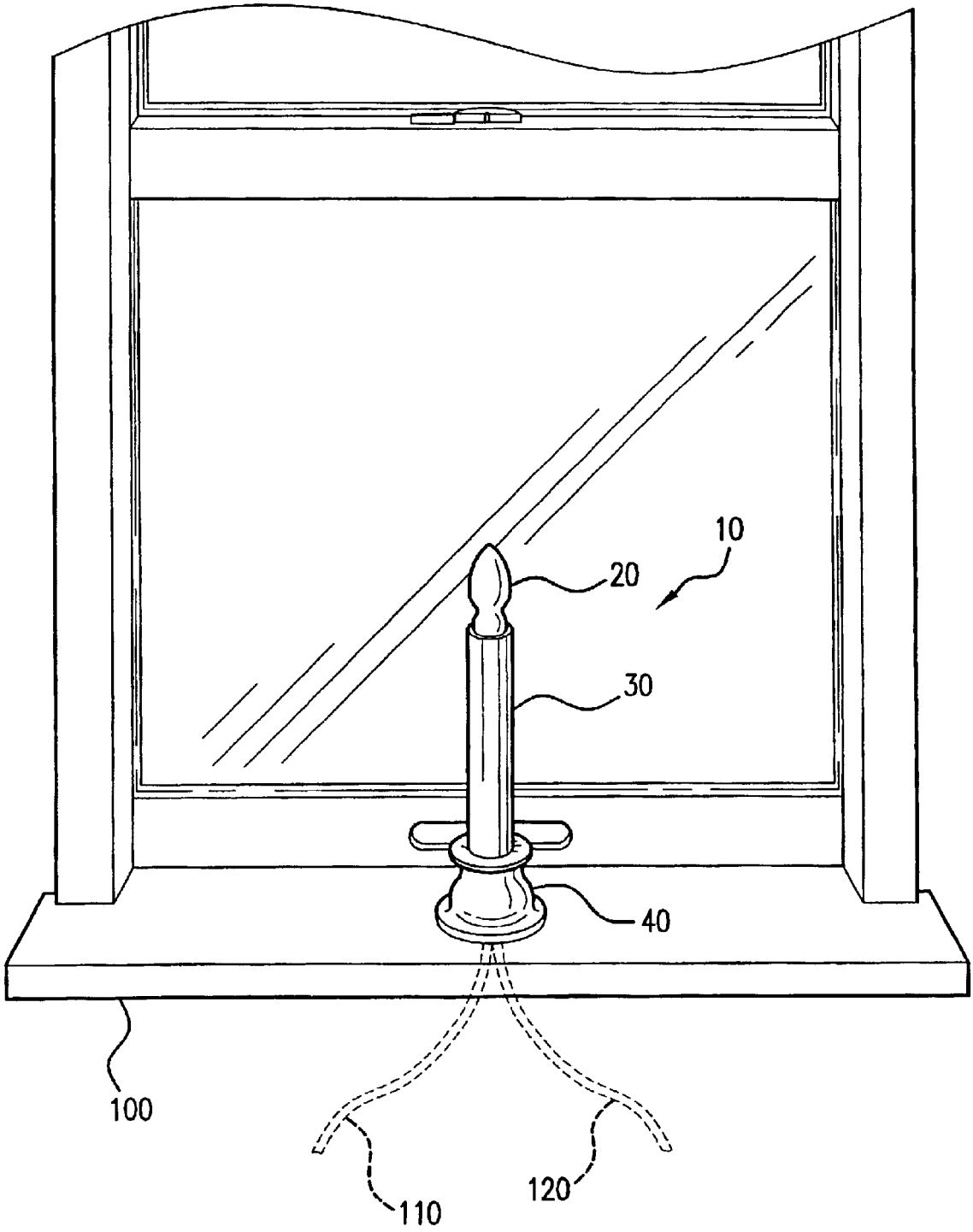
FIG. 1 is a perspective view of the subject system mounted in the window sill of an edifice.

Referring to FIG. 1, the low-power illumination apparatus of the present invention, generally indicated at 10, is shown in a configuration having the appearance of a window candle. The window candle is designed to appear as though it is set upon a window sill 100 where, in fact, as will be shown in paragraphs that follow, the window candle is fixedly attached to window sill 100. The details of the electrical and mechanical attachment of the low-power illumination apparatus are hidden by a decorative base collar 40.

The window candle illustrated in FIG. 1 includes an illumination housing 30 having coupled thereto a low-power electric lamp 20. Illumination housing 30, and therethrough low-power lamp 20, is supplied electrical power via low voltage wiring 110. The low-voltage wiring 110 may be coupled to a low-voltage power source (not shown) such as a 24 VAC supply found in typical modern homes.

Low-power lamp 20 is preferably a low-wattage incandescent bulb, and may be formed in the shape of a candle flame or any other desired configuration. The bulb is threadably inserted into a lamp socket (shown in FIG. 6) and may thereby be interchanged with bulbs of different shapes. However, the power consumption or heat dissipation must be held to safe levels to prevent injury to overly curious persons or pets. In a preferred embodiment of the invention, low-power lamp 20 is a 2 W incandescent bulb driven by 12 VDC. Preferably, low-power lamp 20 produces heat at a temperature less than 45° C.

Several such window candles may be wired in parallel to achieve a desired decorative effect. As shown in FIG. 1, a low-voltage source is coupled to an individual window candle through low-voltage wiring 110 and is further coupled to low-voltage wiring 120. Low-voltage wiring 120 is then routed to provide electrical power to another low-power illumination apparatus 10 in the parallel chain of window candles.

Figure 2:
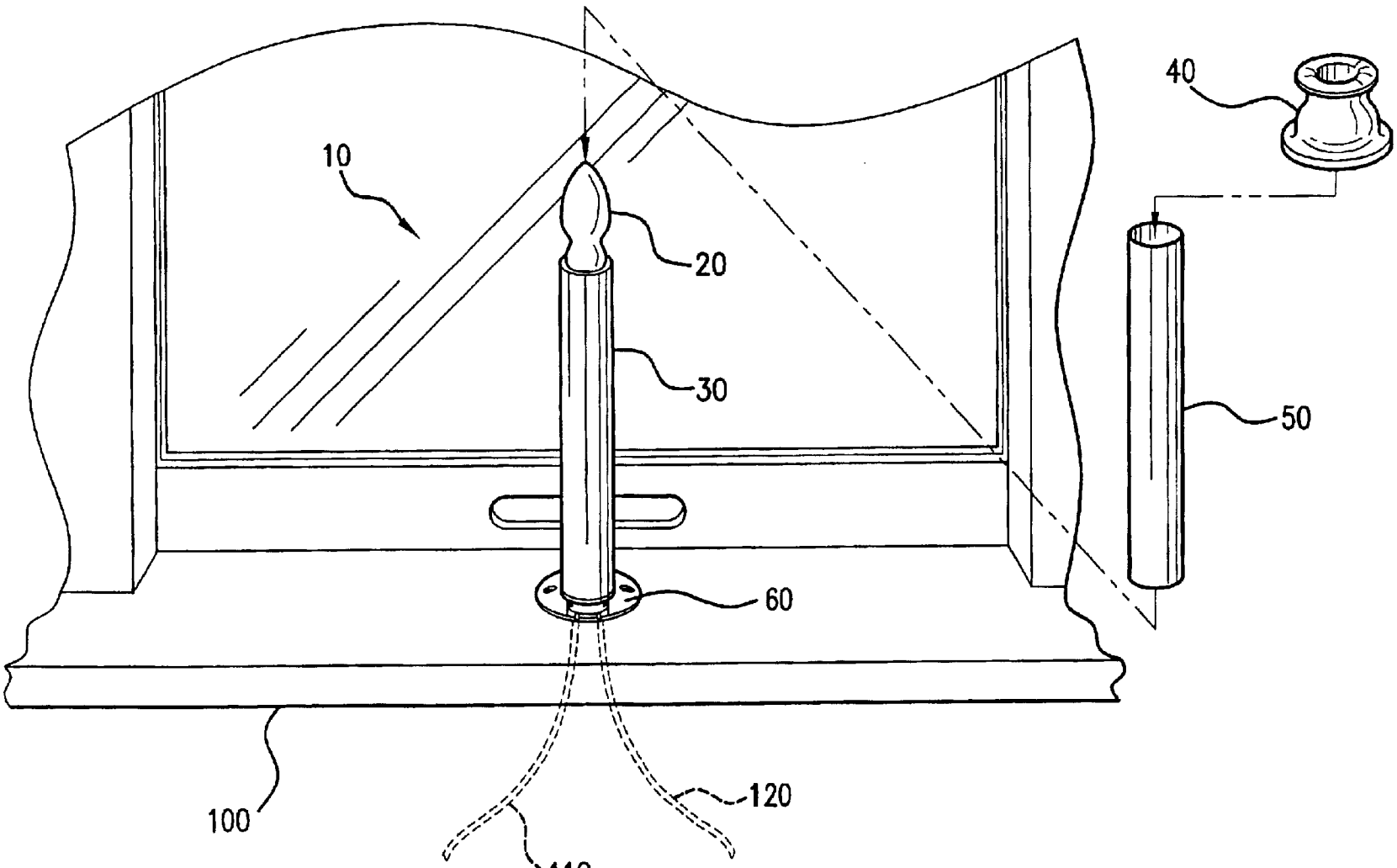
FIG. 2 is a perspective view of the present invention with decorative elements removed to show structural elements.

Referring to FIG. 2, the low-power illumination apparatus 10 is shown with decorative base collar 40 removed from the lower portion of illumination housing 30. Beneath decorative base collar 40 and fixedly attached to window sill 100 is base mounting plate 60, to which illumination housing 30 is mechanically coupled to securely maintain its upright orientation. Electrical coupling is concurrently effected by this mechanical coupling of base mounting plate 60 to illumination housing 30, such that electrical power is provided to low-power lamp 20 via lamp driving circuitry as discussed in paragraphs that follow.

As is illustrated in FIG. 2, illumination housing 30 may be optionally fitted with a decorative sleeve 50 to alter the appearance of the window candle in some way. Decorative sleeve 50 may be of a different color or may carry an aesthetically pleasing design thereon. Decorative sleeve 50 is sized to fit snugly over illumination housing 30, i.e., decorative sleeve 50 is equivalent in length to illumination housing 30 and has an inner cross-sectional diameter substantially equivalent to the exterior cross-sectional diameter of illumination housing 30. When used, decorative sleeve 50 is placed over illumination housing 30 and decorative base collar 40 is placed over decorative sleeve 50 to complete the appearance of a free-standing window candle.

Figure 3:
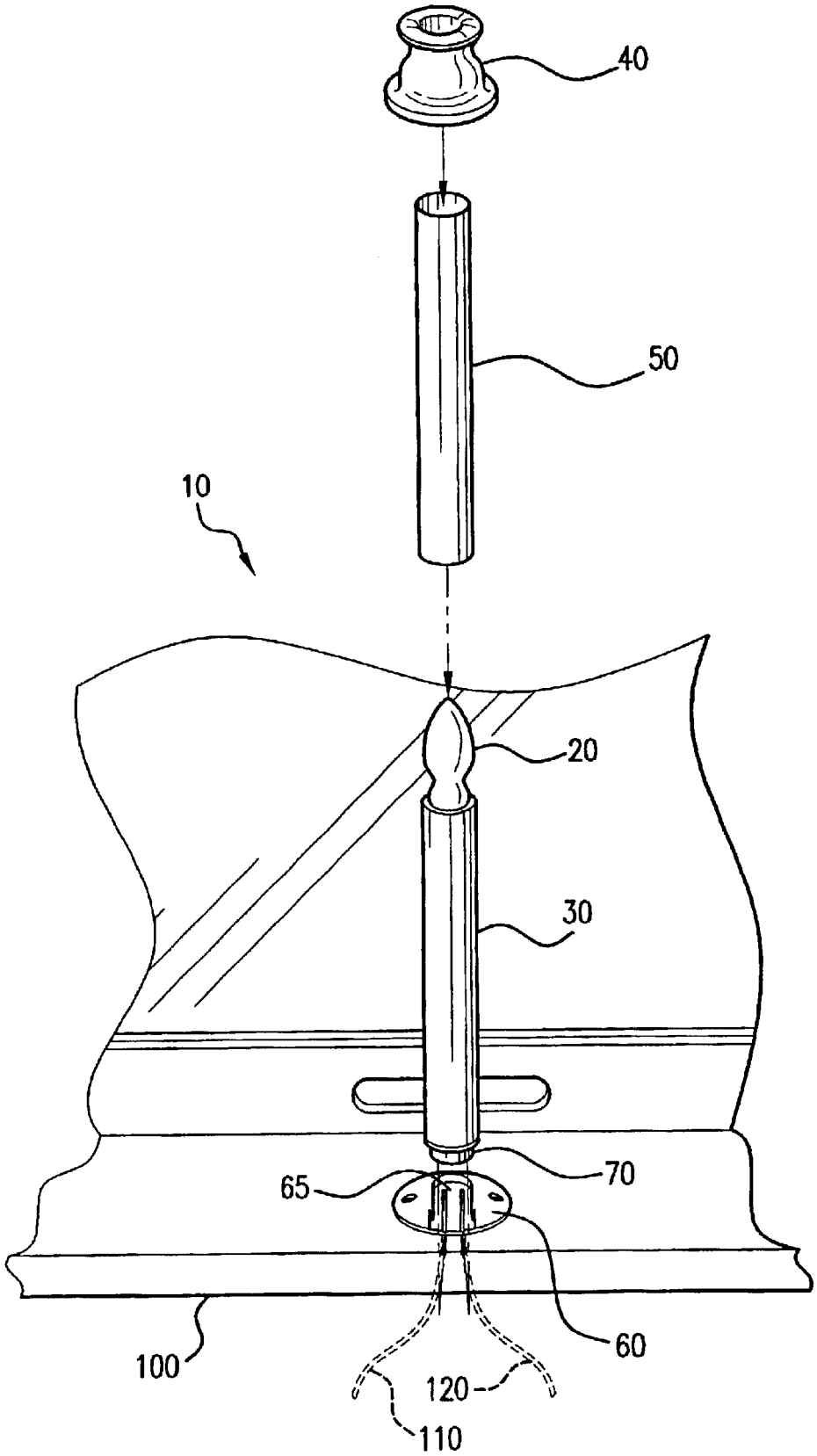
FIG. 3 is a perspective exploded view of the present invention showing operative elements.

As is illustrated in FIG. 3, illumination housing 30 is removable from base mounting plate 60 to provide flexibility in decorating using the low-power illumination apparatus 10 of the present invention. Illumination housing 30 may be removed completely, or may be replaced by an illumination housing of a different size or shape. The removal and replacement of illumination housing 30 are easily performed without the use of tools.

In a preferred embodiment of the invention, base mounting plate 60 has formed thereon a stopped groove 65 for slidable receipt of mating extension 70 disposed on illumination housing 30. Mating extension 70 and stopped groove 65 engage in an interlocking arrangement that prevents illumination housing 30 from being inadvertently tipped over or lifted up away from base mounting plate 60.

Figure 4:
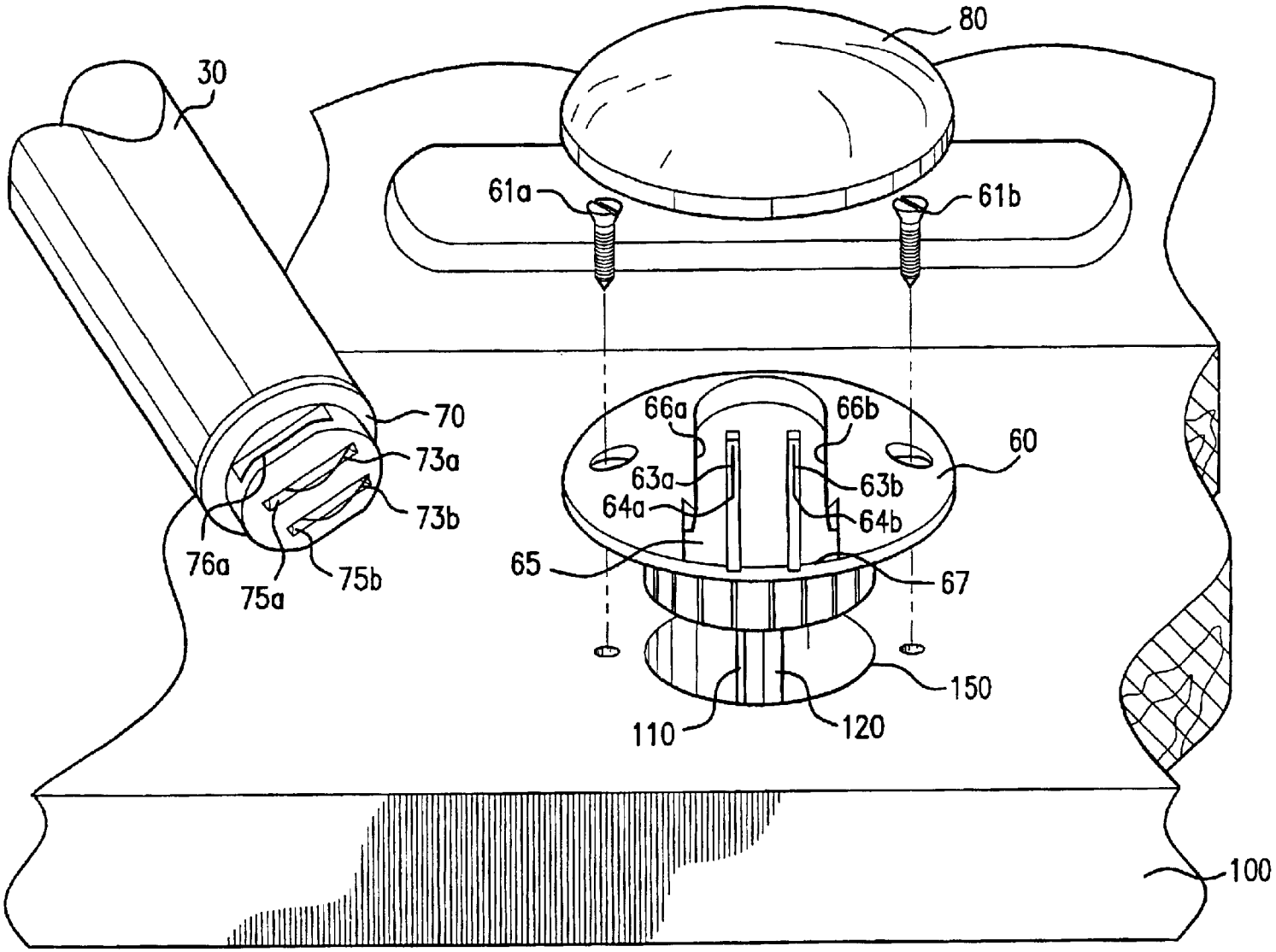
FIG. 4 is a perspective exploded view of the details of the coupling mechanism between the illumination housing and the base mounting plate of the present invention.

Referring to FIG. 4, there is shown in detail the coupling arrangement between illumination housing 30 and base mounting plate 60. As is shown, base mounting plate 60 is electrically coupled to low-voltage wiring 110 at electrodes 63*a*, 63*b* for providing low-power to illumination housing 30. Electrodes 63*a*, 63*b* and low-voltage wiring 110 are also electrically coupled to low-voltage wiring 120 for providing low power to a separate window candle or other low-power electrical device. In the preferred embodiment, low-voltage wiring 110, 120 are routed within the wall framing about the given window sill 100 to emerge from hole 150 formed in window sill 100 so as to allow coupling to base mounting plate 60. With the electrical connection in place, base mounting plate 60 is fixedly attached to window sill 100 by screws 61*a*, 61*b* or other suitable fastening means.

Base mounting plate 60 is preferably molded from flame retardant, UV-stabilized, polymeric thermoplastic material such as acrylonitrile butadiene styrene (ABS) and, as previously stated, has formed thereon stopped groove 65 for slidably receiving mating extension 70 of illumination housing 30. Stopped groove 65 preferably formed with one open end at groove opening 67. The end of stopped groove 65 opposite groove opening 67 is closed so as to prevent the illumination housing 30 from being slid past a position of optimum alignment of electrical contacts.

The surface forming the bottom of stopped groove 65 is installed with two elongated electrodes 63*a*, 63*b*. Electrodes 63*a*, 63*b* are accessibly disposed within elongated electrode openings 64*a*, 64*b* to be recessed relative to the bottom surface of stopped groove 65, situated for alignment with the illumination housing electrodes 73*a*, 73*b*. Each electrode 63*a*, 63*b* is electrically coupled to a corresponding conductor of either or both of low-voltage wiring 110, 120. Moreover, electrodes 63*a*, 63*b* are preferably plated with a metal such as gold to prevent corrosion due to humidity, condensation, and other environmental conditions typically encountered around windows.

Extending laterally into stopped groove 65 from upper portions of opposing walls formed thereabout are protuberances 66*a*, 66*b*. The protuberances 66*a*, 66*b* retentively engage with mating extension 70 to prevent illumination housing 30 from being decoupled from base mounting plate 60 by a longitudinally directed force.

As stated hereinabove, illumination housing 30 has coupled thereto a mating extension 70 for sliding receipt in stopped groove 65 of base mounting plate 60. Mating extension 70 has formed on opposing walls thereof elongated grooves 76*a*, 76*b* (elongated groove 76*b* not visible in the view shown) for slidably engaging with protuberances 66*a*, 66*b* of base mounting plate 60. Elongated grooves 76*a*, 76*b* are formed in mating extension 70 so that the lower lip of grooves 76*a*, 76*b* are thinner than protuberances 66*a*, 66*b* of base mounting plate 60. Thus, an excessive lateral force applied to the upper portion of illumination housing 30 will result in the breaking of mating extension 70 and not in the breaking of base mounting plate 60. In this regard, mating extension 70 incorporates a selected point of failure, given that it is normally less difficult to replace a broken illumination housing 30 than it is to replace a broken base mounting plate 60.

Mating extension 70 has further formed on an end thereof a pair of slotted openings 75*a*, 75*b* through which a pair of illumination housing electrodes 73*a*, 73*b* emerge for electrical coupling to electrodes 63*a*, 63*b* of base mounting plate 60. Illumination housing electrodes 73*a*, 73*b* are preferably constructed from thin wire to form resilient wiper springs 73*a*, 73*b* and are, like electrodes 63*a*, 63*b*, preferably plated with gold. As will be discussed in further paragraphs, wiper springs 73*a*, 73*b* are electrically coupled to voltage conversion circuitry for supplying power to low-power lamp 20.

To engage illumination housing 30 in base mounting plate 60, illumination housing 30 is held in an upright orientation so that elongated grooves 76*a*, 76*b* are aligned with protuberances 66*a*, 66*b* of base mounting plate 60 at groove opening 67. Illumination housing 30 is then slid into stopped groove 65 until mating extension 70 is fully inserted and stopped within stopped groove 65. In this position, wiper springs 73*a*, 73*b* will be in contact with electrodes 63*a*, 63*b* and electrical coupling between illumination housing 30 and base mounting plate 60 will be established. Further, as wiper springs 73*a*, 73*b* are formed from a resilient material, wiper springs 73*a*, 73*b* will bias the bottom walls of elongated grooves 76*a*, 76*b* against protuberances 66*a*, 66*b* thereby preventing illumination housing 30 from wobbling or leaning within stopped groove 65. Once illumination housing 30 has been fully seated in base mounting plate 60, one or both of the optional decorative sleeve 50 and decorative base collar 40 may be slid over illumination housing 30, as previously discussed.

When illumination housing 30 is removed from base mounting plate 60, base mounting plate 60 may be protected by a cover plate 80 as shown in FIG. 4. Cover plate 80 may be manufactured from an elastic material, such as rubber, and may be optionally fitted with means for attachment to window sill 100 so as to prevent its unintentional or unauthorized removal.

Figure 5:
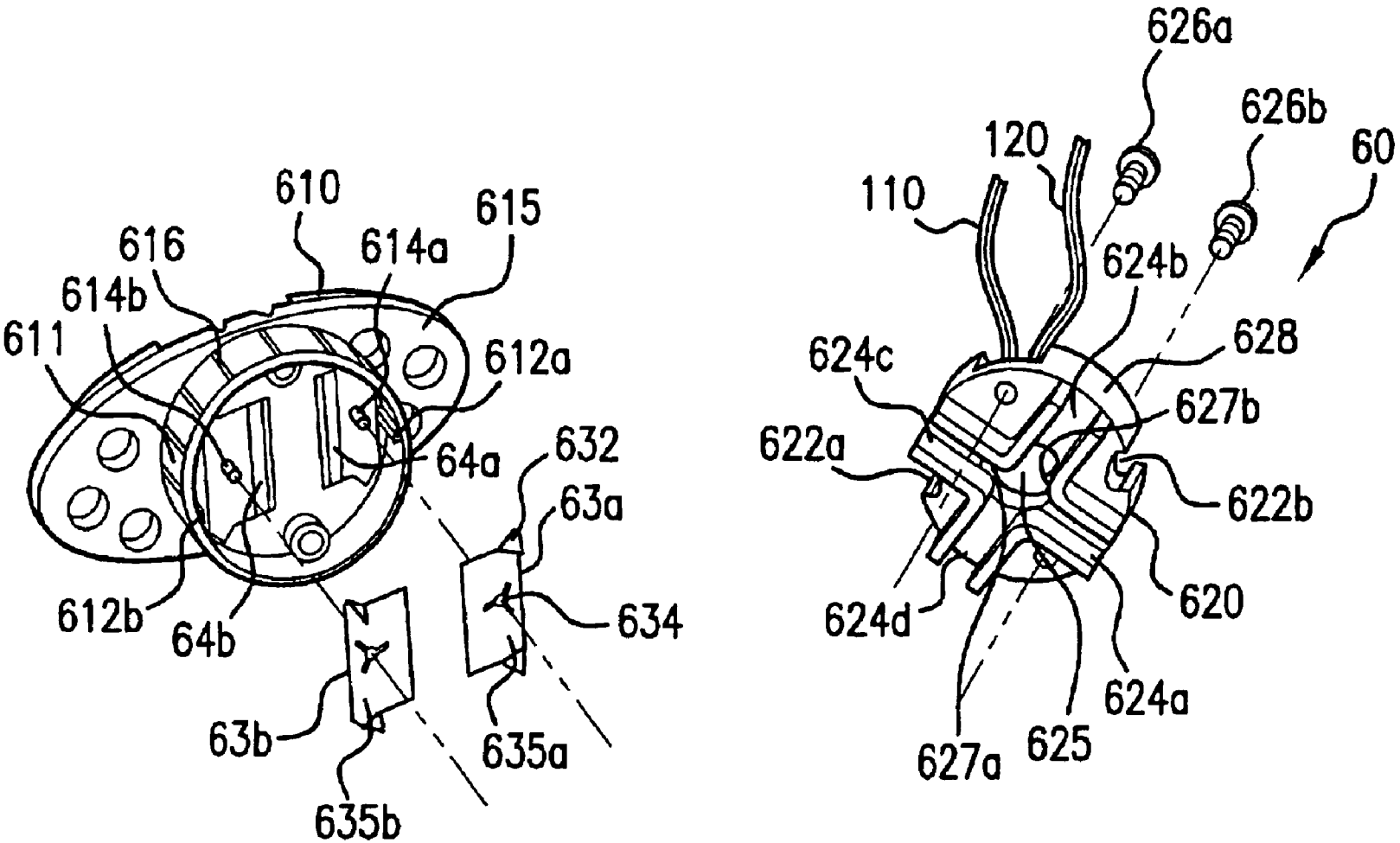
FIG. 5 is a perspective exploded view of the base mounting plate of the present invention showing wiring features.

The internal structure of the wiring mechanism of the low-power illumination apparatus is shown in FIG. 5. As is illustrated, base mounting plate 60 is assembled from a mounting clip 610, a pair of electrodes 63*a*, 63*b* and a wire lock mechanism 620. The combination of elements that form base mounting plate 60 provides a compact, fool-proof wiring mechanism for interconnecting a plurality of window candles.

The wiring mechanism is made compact by the configuration of electrodes 63*a*, 63*b*, each of which serve three main functions. First, the planar electrode bodies 635*a*, 635*b* of electrodes 63*a*, 63*b* are positioned beneath the surface of stopped groove 65 to be at least partially revealed through elongated electrode opening 64*a*, 64*b*. The revealed portions of electrodes 63*a*, 63*b* are accessible for contact by wiper springs 73*a*, 73*b* of the illumination housing's mating extension 70, as discussed hereinabove.

The second function performed by electrodes 63*a*, 63*b* is providing electrical continuity between low-voltage supply wiring 110 and low-voltage branch wiring 120. In other words, a leg of low-voltage wire set 110 is electrically coupled to a leg of wire set 120 by one electrode 63*a*, and the other leg of wire set 110 is electrically coupled to that of wire set 120 by electrode 63*b*.

Finally, the third function performed by the electrodes 63*a*, 63*b* is providing the mechanical means for making the electrical connection between low-voltage wiring 110, 120. Each electrode 63*a*, 63*b* has formed thereon a pair of insulation displacement spurs 632. When base mounting plate 60 is fully assembled, insulation displacement spur 632 pierces the insulation of one leg of low voltage wiring 110, 120 at each end of electrodes 63*a*, 63*b* and is embedded in the conducting region sheathed therein.

A mounting clip 610 provides both mounting means for the base mounting plate 60 as well as an enclosure for safely encasing the wiring mechanism. Mounting flange 615 extending outward from mounting clip 610 provides a structure by which base mounting plate 60 may be firmly fastened to window sill 100. On the underside of mounting flange 615, there is formed a cylindrical shell 611 which serves as the wiring mechanism housing. Cylindrical shell 611 has formed thereon a plurality of longitudinal ribs 616. When base mounting plate 60 is inserted into a properly sized hole 150 in window sill 100, longitudinal ribs 616 engage the walls of hole 150 to prevent rotation of base mounting plate 60 when screws 61*a*, 61*b* have not been installed.

The interior walls of cylindrical shell 611 have formed thereon a pair of longitudinally oriented alignment keys 612*a*, 612*b*. The alignment keys 612*a*, 612*b* are complementary features to a plurality of keyways 622*a*, 622*b* formed in wire lock 620. Alignment keys 612*a*, 612*b* ensure the correct orientation of the wire lock 620 with respect to electrodes 63*a*, 63*b* so that base mounting plate 60 is properly wired.

Wire lock 620 serves to ensure the correct wiring of base mounting plate 60, providing a plurality of wire guides 624*a*–624*d* and a wire pairing channel 625. Wire pairing channel 625 is centrally located on wire lock 620 and comprises a substantially square hole having formed on two opposing walls thereof an inwardly protruding cable separator 627*a*, 627*b*. Low voltage wiring pair 110 is inserted through wire pairing channel 625 on one side of cable separator 627*a*, 627*b* and low voltage wiring pair 120 is threaded through wire pairing channel 625 on the other side of cable separator 627*a*, 627*b*. In so doing, each conductor of low voltage wiring pairs 110, 120 is in its proper position in wire lock 620 so as to facilitate the correct interconnection of conductors by electrodes 63*a*, 63*b* during full assembly of base mounting plate 60.

After low voltage wiring 110, 120 has been threaded through wire pairing channel 625, the individual conductors thereof are separated and laid into the wire guides 624*a*–624*d*. Wire pairing channel 625 is oriented so that the separate conductors of low voltage wiring pairs 110, 120 emerge adjacent to one of the wire guides 624*a*–624*d*. The individual conductors of low voltage wiring pairs 110, 120 and may then be coupled by electrodes 63*a*, 63*b* in the manner described above.

To assemble base mounting plate 60, electrodes 63*a*, 63*b* are positioned over a corresponding one of electrode mounting studs 614*a*, 614*b* such that insulation displacement spurs 632 are in close proximity to the interior wall of cylindrical shell 611. Each of the electrodes 63*a*, 63*b* are then pushed onto electrode mounting stud 614*a*, 614*b* and held in place by a plurality of prongs projecting inward on stud receiving aperture 634. Thereafter, with low voltage wiring 110, 120 positioned in wire lock 620 as described above, keyways 622*a*, 622*b* formed in circumferential wall 628 are aligned with alignment keys 612*a*, 612*b* of mounting clip 610, and wire lock 620 is pressed into the interior of cylindrical shell 611. In this manner, insulation displacement spurs 632 are pressed into the individual conductors of low voltage wiring 110, 120 in the manner described above, and base mounting plate 60 is then electrically coupled to the low voltage wiring system. Wire lock 620 is retained within the cylindrical shell 611 of mounting clip 610 by screws 626*a*, 626*b*.

Figure 6A:
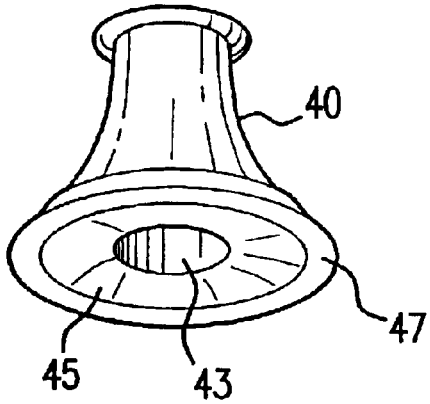
FIG. 6A, FIG. 6B, and FIG. 6C are illustrations of the decorative base collar of the present invention.

Decorative base collar 40 of the low-power illumination apparatus 10 serves not only an aesthetic function, but also serves to prevent illumination housing 30 from being inadvertently removed from base mounting plate 60. As illustrated in FIG. 6A, the underside of decorative base collar 40 has formed thereon a recess 45 corresponding in shape and size to base mounting plate 60. Thus, when illumination housing 30 is placed in longitudinal bore 43, and decorative base collar 40 is allowed to slide to the bottom of illumination housing 30, recess 45 of decorative base collar 40 will envelop base mounting plate 60 so that lower rim 47 of decorative base collar 40 is placed in direct contact with the surface of window sill 100. As illumination housing 30 may only be removed from base mounting plate 60 by the sliding action described above, illumination housing 30 may not be removed with decorative base collar 40 fully in place. Illumination housing 30 is prevented from lateral motion by recess 45 engaging with the edges of base mounting plate 60.

Figure 6B:
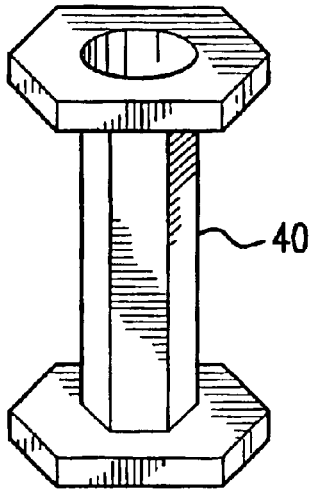
Figure 6C:
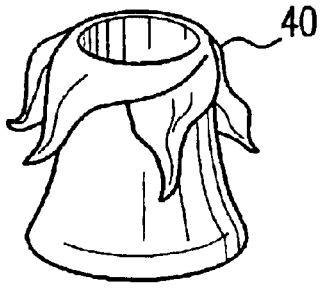

FIGS. 6B and 6C illustrate two alternative candle holder styles. In accordance with the present invention, decorative base collar 40 may embody any candle holder style but should incorporate longitudinal bore 43 and recess 45 to provide the safety feature described in the previous paragraph.

Figure 7:
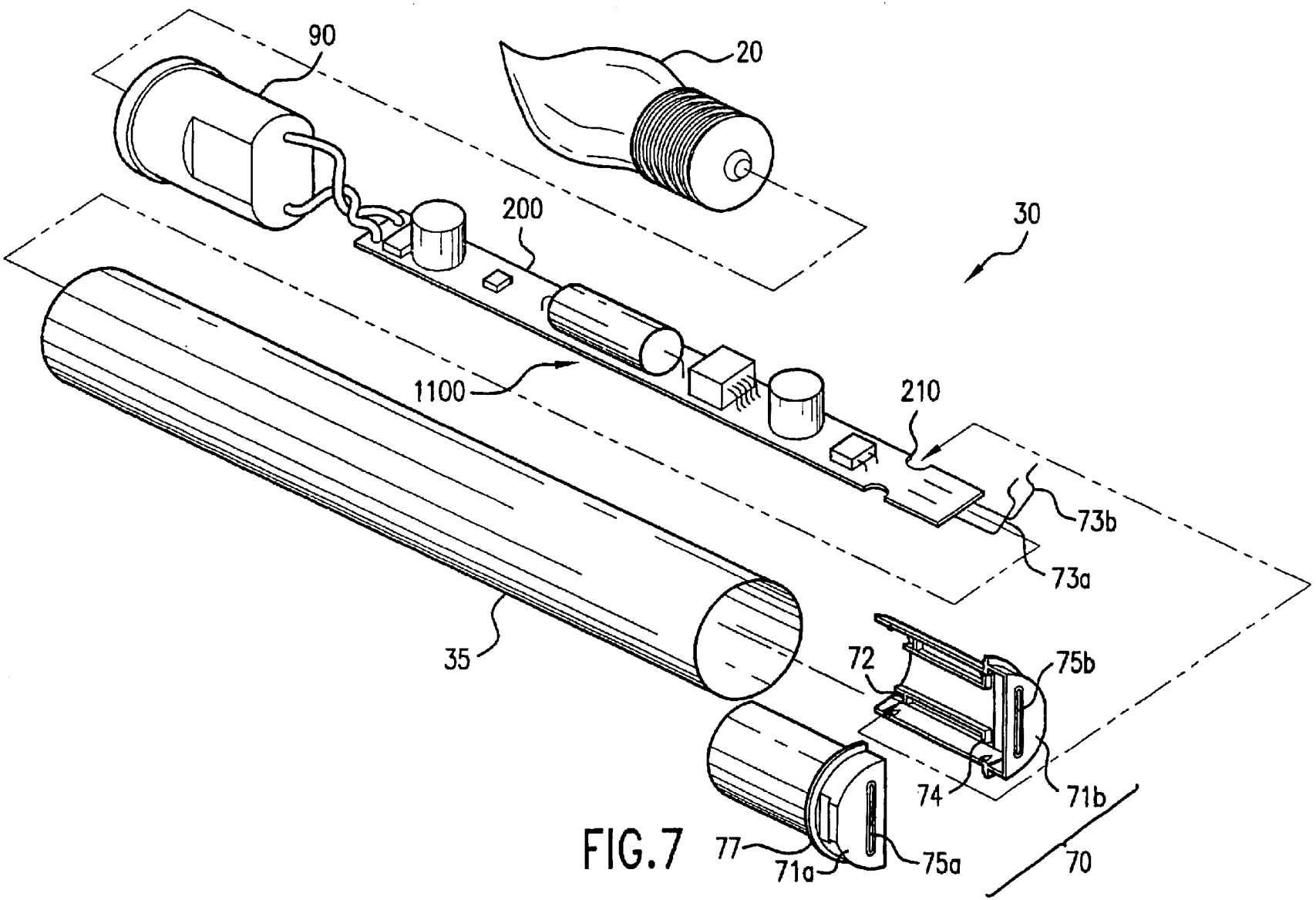
FIG. 7 is an exploded view illustration of the illumination housing of the present invention.

Referring to FIG. 7, the construction of illumination housing 30 is illustrated in detail. Illumination housing 30 includes a cylindrical housing tube 35 having coupled at one end thereof mating extension 70. Housing tube 35 and mating extension 70 are preferably molded from flame-retardant, ultraviolet-stabilized ABS. In the preferred embodiment, mating extension 70 is formed from two identical complementary half-cylindrical sections 71*a*, 71*b* which, when mated together along a longitudinally bisecting plane, form the cylindrical mating extension 70. The mated sections of mating extension 70 are inserted into one end of housing tube 35 and are held therein by a snap-fit mechanism of known type. When housing extension member 70 is in its fully seated position, circumferential ridge 77 contacts the periphery of the end of housing tube 35.

In the end of housing tube 35 opposite the mating extension 70, a circuit board 200, having constructed thereon a voltage conversion circuit 1100, is inserted so that wiper springs 73*a*, 73*b* are positioned in slotted openings 75. With the end of circuit board 200 extending past the end of housing tube 35 opposite to that in which it was inserted, the two halves of housing extension member 70 are mated to enclose the end of circuit board 200 in circuit board retaining slot 72 such that wiper springs 73*a*, 73*b* protrude from slotted openings 75*a*, 75*b* and circuit board notch 210 is engaged with boss 74. In this arrangement, circuit board 200 is prohibited from moving longitudinally within housing tube 35. Thus, the force of wiper springs 73 against electrode 63 of base mounting plate 60 is transferred to the entire illumination housing 30 so as to promote even contact between elongated grooves 76*a*, 76*b* of mating extension 70 and protuberances 66*a*, 66*b* of base mounting plate 60.

With circuit board 200 placed in circuit board retaining slot 72 and notches 210 engaged with bosses 74, the assembled housing extension member 70 containing circuit board 200 is inserted into housing tube 35. At the opposite end of housing tube 35, lamp socket 90 is inserted and is held in place by friction fit engagement. Lamp socket 90 and housing tube 35 may contain relative motion prevention means so as to prevent lamp socket 90 from spinning within the end of housing tube 35 when low-power lamp 20 is threaded into lamp socket 90.

Figure 8:
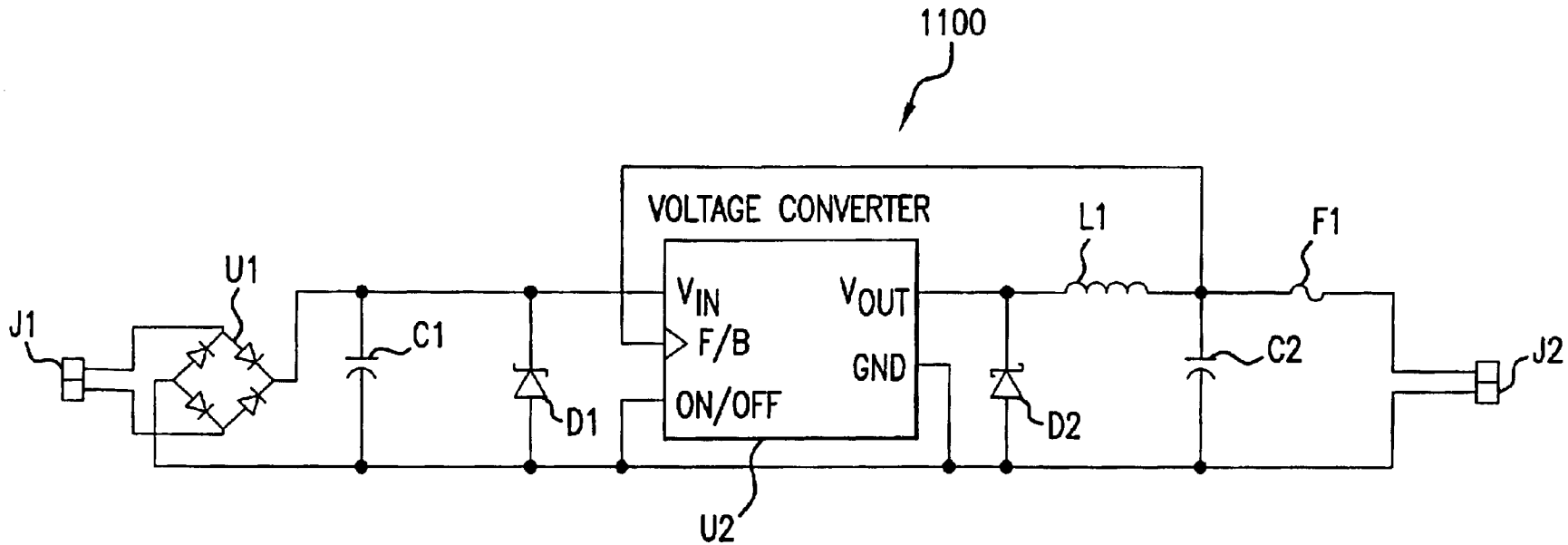
FIG. 8 is a schematic diagram of the voltage converter circuit of the present invention.

Referring to FIG. 8, a voltage conversion circuit 1100 is schematically depicted. The voltage converter circuit 1100, constructed on circuit board 200, is used to decrease the voltage level for supplying power to low-power lamp 20. In the preferred embodiment, the voltage supplied to power converter circuit 1100 is 24 VAC and the voltage level supplied by power converter circuit 1100 is 12 VDC. In FIG. 8, 24 VAC is provided at J1 which is electrically coupled to wiper springs 73*a*, 73*b* of circuit board 200. The 24 VAC is rectified by full-wave rectifier U1 and filtered to a DC level by capacitor C1. Breakdown diode D1 is provided as transient voltage relief.

The rectified DC voltage is coupled to the input of voltage converter chip U2, which is preferably an LM2575 step-down voltage regulator manufactured by National Semiconductor Corporation or an equivalent integrated circuit. Voltage converter chip U2, in conjunction with Schottky diode D2 and energy storage inductor L1, form the basis of a step-down regulator for producing 12 VDC. Output filter capacitor C2 performs the final filtering of the DC voltage.

The load voltage of the power converter circuit taken at output filter capacitor C2 is protected by resettable fuse F1. In the preferred embodiment, resettable fuse F1 is a polymeric positive temperature coefficient device whose input impedance increases dramatically, i.e., to essentially an open circuit, at a predetermined threshold temperature. The threshold temperature is reached when an over-current condition exists and, once the over-current condition is removed and the device has cooled, the polymeric positive temperature coefficient device will return to a low impedance state.

The protected output voltage is supplied to J2 which is electrically coupled to lamp socket 90. Thus, when a lamp having a higher than specified power consumption level or heat dissipation temperature is threaded into lamp socket 90, resettable fuse F1 will "trip" and will remain in a high impedance state until a lower wattage bulb is threaded into lamp socket 90.

In an alternate embodiment of the present invention, the window candle's proximity to and positioning within the boundaries of a window opening are advantageously exploited. One or more window candles in a decorative illumination system is equipped with an auxiliary circuit such as an alarm sensor which when disturbed by a would-be intruder, activates an alarm. The auxiliary circuit or alarm sensor may be a shock/vibration sensitive circuit, infrared detector, or may be as simple as an electrical continuity type sensor which would trigger an alarm if an illumination housing 30 is removed from base plate 60 without authorization such as being upset by an intruder entering through the window.

Figure 9:
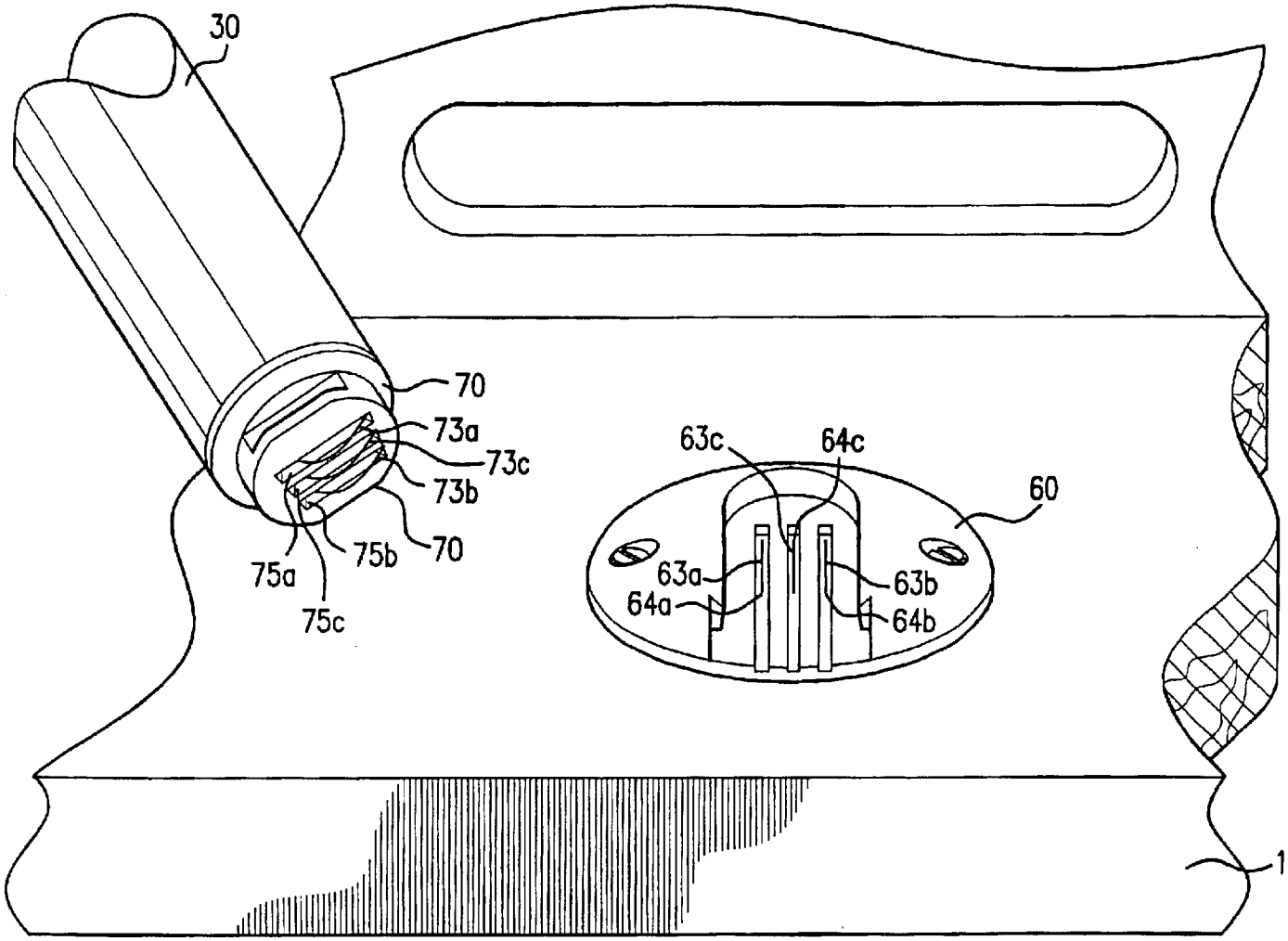
FIG. 9 is a perspective exploded view of the coupling mechanism between the illumination housing and the base mounting plate of a three-contact embodiment of the present invention; and, FIGS. 10A and 10B are block circuit diagrams showing the connection of an auxiliary circuit to the power conversion circuit of the three-contact embodiment of the present invention.

FIG. 9 illustrates an exemplary electrical contact configuration which could be used to provide means for transmitting a signal from an auxiliary circuit. As is shown in the Figure, mating extension 70 has formed thereon three slotted openings 75*a*, 75*b*, 75*c* through which three illumination housing electrodes 73*a*, 73*b*, 73*c* extend. Correspondingly, base mounting plate 60 includes three electrodes 63*a*, 63*b*, 63*c* which are revealed in elongated electrode openings 64*a*, 64*b*, 64*c*. As in the previous embodiment, electrodes 63*a*, 63*b* and corresponding wiper springs 73*a*, 73*b* are used to supply power to the circuitry within illumination housing 30. The third electrode 63*c*, and corresponding wiper spring 73*c*, can be used to carry an alarm indication or any other appropriate signal from an auxiliary circuit also located in illumination housing 30. The auxiliary circuit may be constructed on the same circuit board 200 on which the voltage conversion circuit previously described is constructed.

Figure 10A:
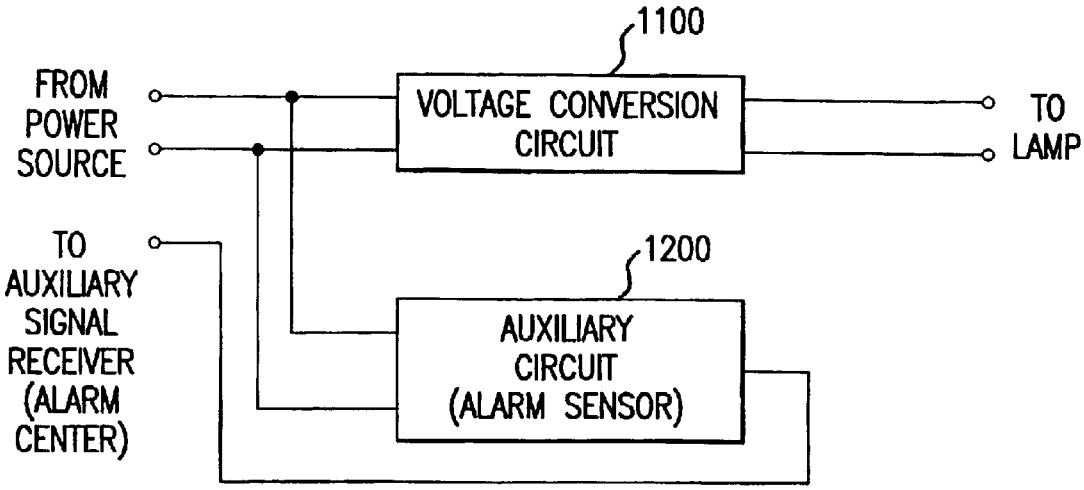
Figure 10B:
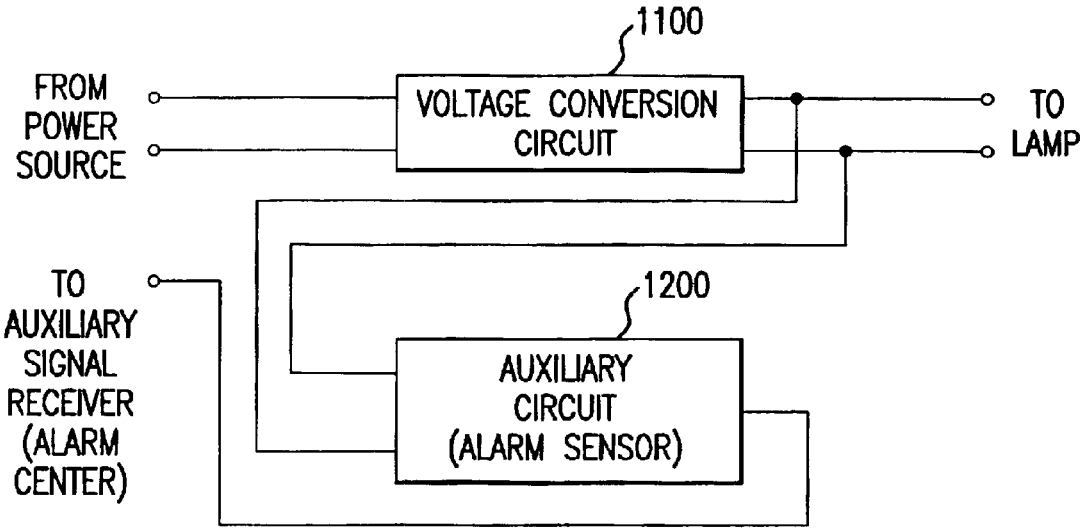

FIGS. 10A and 10B illustrate possible wiring configurations of auxiliary circuit 1200 to voltage conversion circuit 1100. In the circuit of FIG. 10A, power to auxiliary circuit 1200 is derived directly from the external power source and would be directly coupled to wiper springs 73*a*, 73*b*. The output of auxiliary circuit 1200 would be carried over wiper spring 73*c* and would be electrically coupled to a remote receiver such as centrol alarm system. FIG. 10B illustrates a similar circuit where power to auxiliary circuit 1200 is derived from the output of voltage conversion circuit 1100 as, in the preferred embodiment, voltage conversion circuit 1100 supplies DC power.

Although the invention has been described herein in conjunction with specific embodiments thereof, many alternatives, modifications and variations will be apparent to those skilled in the art. The present invention is intended to embrace all such alternatives, modifications, and variations that fall within the spirit and broad scope of the appended Claims.

What is claimed is:

1. A low-power illumination apparatus comprising:

a base mounting plate adapted to be fixedly secured to a frame structure, said base mounting plate being electrically coupled to an external power source;

illumination means for providing low-power illumination, said illumination means including an illumination housing slidably receivable in said base mounting plate to a fixedly retained position for electrically coupling said illumination means to said base mounting plate and slidably removable from said base mounting plate for electrically decoupling said illumination means from said base mounting plate; and an elongated circuit board received in said illumination housing of said illumination means, said elongated circuit board having mounted thereon means for converting a first voltage from said external power source to a second voltage for operating said low-power illumination apparatus.

2. The low-power illumination apparatus as recited in claim 1, wherein said base mounting plate includes a stopped groove formed therein for receipt of said illumination means.

3. The low-power illumination apparatus as recited in claim 2, wherein said base mounting plate includes a plurality of electrodes electrically coupled to said external power source.

4. The low-power illumination apparatus as recited in claim 3, wherein said electrodes are recessed within an upper surface defining said stopped groove of said base mounting plate.

5. The low-power illumination apparatus as recited in claim 4, wherein said base mounting plate is electrically coupled to said external power source by a first wire pair and is electrically coupled to an external circuit by a second wire pair.

6. The low-power illumination apparatus as recited in claim 5, wherein each of said electrodes includes a planar electrode body and at least one insulation displacement spur, said insulation displacement spur projecting orthogonally from said planar electrode body.

7. The low-power illumination apparatus as recited in claim 6, wherein said base mounting plate includes a wire lock having a plurality of wire guides formed in an upper surface thereof, each of said wire guides receiving a conductor of one of said first wire pair or said second wire pair.

8. The low-power illumination apparatus as recited in claim 7, wherein said base mounting plate includes a cylindrical shell projecting from a lower surface thereof, said cylindrical shell receiving said plurality of electrodes and said wirelock therein.

9. The low-power illumination apparatus as recited in claim 8, wherein said cylindrical shell has formed on an outer surface thereof a plurality of longitudinally oriented ribs.

10. The low-power illumination apparatus as recited in claim 9, further including:

a plurality of longitudinally oriented alignment keys formed on an interior wall of said cylindrical shell, said plurality of alignment keys radially protruding from said interior wall of said cylindrical shell;

a longitudinally extending wall on the circumference of said wire lock, said longitudinally extending wall having formed thereon a plurality of keyways corresponding in position to one of said plurality of alignment keys on said cylindrical shell such that said wire lock is received in said cylindrical shell in a predetermined orientation.

11. The low-power illumination apparatus as recited in claim 10, wherein:

a first one of said electrodes is electrically coupled to a first conductor of said first wire pair through a first one of said at least one insulation displacement spurs and is electrically coupled to a first conductor of said second wire pair through a second one of said at least one insulation displacement spurs; and a second one of said electrodes is electrically coupled to a second conductor of said first wire pair through a first one of said at least one insulation displacement spurs and is electrically coupled to a second conductor of said second wire pair through a second one of said insulation displacement spurs, where each of said first and second conductors of said first wire pair and said first and second conductors of said second wire pair are retained in said wire lock by said plurality of wire guides.

12. The low-power illumination apparatus as recited in claim 11, wherein said external circuit includes a duplicate low-power illumination apparatus.

13. The low-power illumination apparatus as recited in claim 1 further including a cover member for covering said base mounting plate when said illumination means is removed from said base mounting plate.

14. The low-power illumination apparatus as recited in claim 13, wherein said cover member is fixedly securable to said frame structure.

15. The low-power illumination apparatus as recited in claim 1, wherein said illumination means includes:

(a) said illumination housing having opposing first and second ends;

(b) a low-power lamp mounted on said first end of said housing;

(c) said means for converting said first voltage from said external power source to said second voltage for operating said low-power lamp, said second voltage being less than said first voltage; and (d) means for electrically and structurally coupling said second end of said housing to said base mounting plate.

16. The low-power illumination apparatus as recited in claim 15, wherein said means for electrically and structurally coupling said second end of said housing to said base mounting plate includes:

(a) a plurality of housing electrodes, wherein two of said plurality of housing electrodes are electrically coupled to said means for converting said first voltage to said second voltage; and (b) a mating extension member having a plurality of through openings for extension therethrough of said plurality of housing electrodes.

17. The low-power illumination apparatus as recited in claim 16, wherein said mating extension member has formed thereon an elongated groove formed on each of opposing sides thereof for sliding receipt within a stopped groove formed within said base mounting plate.

18. The low-power illumination apparatus as recited in claim 17, wherein said stopped groove includes a protuberance longitudinally extending along an upper periphery of each of opposing walls of said stopped groove to engage with each of said elongated grooves of said mating extension member.

19. The low-power illumination apparatus as recited in claim 18, wherein each of said housing electrodes includes a resilient wiper spring for forcing upward each of said elongated grooves into contact with each of said protuberances.

20. The low-power illumination apparatus as recited in claim 15, wherein said means for converting said first voltage to said second voltage includes:

(a) means for electrically decoupling said second voltage from said low-power lamp when said low-power lamp consumes power exceeding a predetermined power consumption level; and (b) a DC—DC power converter for providing said second voltage, said DC—DC power converter electrically coupled to said means for electrically decoupling said second voltage from said low-power lamp.

21. The low-power illumination apparatus as recited in claim 20, wherein said means for electrically decoupling said second voltage from said low-power lamp is a resettable fuse.

22. The low-power illumination apparatus as recited in claim 20 further including rectifying means for converting an AC voltage provided as said first voltage to a DC voltage for coupling to said DC—DC power converter.

23. The low-power illumination apparatus as recited in claim 22, wherein said first voltage is 24 VAC and said second voltage is 12 VDC.

24. The low-power illumination apparatus as recited in claim 15, wherein said low-power lamp dissipates heat at a temperature not greater than 45° C.

25. The low-power illumination apparatus as recited in claim 15, wherein said illumination housing includes a tubular member for containing said elongated circuit board.

26. The low-power illumination apparatus as recited in claim 25, wherein said tubular member is formed from flame-retardant UV-stabilized Acrylonitrile-Butadiene-Styrene (ABS).

27. The low-power illumination apparatus as recited in claim 25 further including an elongated outer sleeve placed over said tubular member, said outer sleeve being equivalent in length to said tubular member and having an inner diameter substantially equivalent to an outer diameter of said tubular member.

28. The low-power illumination apparatus as recited in claim 15 further including a base collar having a longitudinal bore formed therethrough and a recess on a lower surface thereof, said base collar being placed over said base mounting plate such that said base mounting plate is received in said recess and said illumination housing extends through said longitudinal bore so as to prevent said illumination housing from being slidably removed from said base mounting plate.

29. The low-power illumination apparatus as recited in claim 15, wherein said illumination means includes an auxiliary circuit, said auxiliary circuit providing a signal at an output terminal thereof, said output terminal electrically coupled to a central receiver through one of said plurality of housing electrodes and a corresponding one of a plurality of electrodes in said base mounting plate.

30. The low-power illumination apparatus as recited in claim 29, wherein said auxiliary circuit is an alarm sensor and said signal is an alarm signal indicating an intrusion at an installation site of said alarm sensor.

31. The low-power illumination apparatus as recited in claim 30, wherein said alarm sensor is a shock/vibration sensor.

32. The low-power illumination apparatus as recited in claim 30, wherein said alarm sensor is an infra-red detector.

33. The low-power illumination apparatus as recited in claim 30, wherein said alarm sensor is a continuity circuit, wherein said signal indicates to said central receiver when said illumination means is removed from said base mounting plate.

34. The low-power illumination apparatus as recited in claim 29, wherein said auxiliary circuit is electrically coupled to said external power source at input terminals of said means for converting said first voltage to said second voltage.

35. The low-power illumination apparatus as recited in claim 29, wherein said auxiliary circuit is electrically coupled to output terminals of said means for converting said first voltage to said second voltage.

36. A low-power illumination apparatus comprising:

a base mounting plate adapted to be fixedly secured to a frame structure, said base mounting plate being electrically coupled to an external power source by a wire pair, said base mounting plate including:

(a) a wire lock having a plurality of wire guides formed in an upper surface thereof, each of said wire guides receiving a conductor of said wire pair, and (b) a cylindrical shell projecting from a lower surface thereof, said cylindrical shell receiving said plurality of electrodes and said wirelock therein; and illumination means for providing lowpower illumination, said illumination means being slidably receivable in said base mounting plate to a fixedly retained position for electrically coupling said illumination means to said base mounting plate and being slidably removable from said base mounting plate for electrically decoupling said illumination means from said base mounting plate;

wherein a plurality of longitudinally oriented alignment keys are formed on an interior wall of said cylindrical shell, said plurality of alignment keys radially protruding from said interior wall of said cylindrical shell, and a longitudinally extending wall is formed on the circumference of said wire lock, said longitudinally extending wall having formed thereon a plurality of keyways corresponding in position to one of said plurality of alignment keys on said cylindrical shell such that said wire lock is received in said cylindrical shell in a predetermined orientation.

37. A low-power illumination apparatus Comprising:

a base mounting plate adapted to be fixedly secured to a frame structure, said base mounting plate being electrically coupled to an external power source; and illumination means for providing low-power illumination, said illumination means including an illumination housing slidably receivable in said base mounting plate to a fixedly retained position for electrically coupling said illumination means to said base mounting plate and slidably removable from said base mounting plate for electrically decoupling said illumination means from said base mounting plate; and said illumination means including an auxiliary circuit generating a signal indicating an intrusion at an installation site of the illumination apparatus.

38. The low-power illumination apparatus as recited in claim 37, wherein said low-power lamp dissipates heat at a temperature not greater than 45° C.

* * * * *